United States Patent [19]

Rhee

[11] 4,193,135

[45] Mar. 18, 1980

[54] PROTECTIVE DEVICE FOR THE HAND

[76] Inventor: Jhoon G. Rhee, 4068 Rosamora Ct., Arlington, Va. 22207

[21] Appl. No.: 905,470

[22] Filed: May 12, 1978

[51] Int. Cl.[2] ..... A41D 19/00

[52] U.S. Cl. ..... 2/162

[58] Field of Search ..... 2/161 P, 162, 159, 16, 2/20, 161 R, 161 A; 273/54 B; 128/89 R, 90

[56] References Cited

U.S. PATENT DOCUMENTS

| | | | |
|---|---|---|---|
| 3,269,728 | 8/1966 | Blough | 2/16 X |
| 3,626,515 | 12/1971 | Murray | 2/161 A X |
| 3,790,168 | 2/1974 | Hashimoto | 273/54 B |
| 3,871,029 | 3/1975 | Hollman | 2/161 A |

*Primary Examiner*—Doris L. Troutman
*Attorney, Agent, or Firm*—James C. Wray

[57] ABSTRACT

This invention relates to a protective device adapted to protect the hand, palm and wrist of a person while one is engaging in a sporting activity, such as skateboarding or football, and can also be used to retain the hand, palm, and wrist substantially immobile after an injury. The device has a contoured, generally rectangular shape constructed of a resilient, energy-absorbent material, such as plastic foam, which is coated or covered on at least one side with a covering layer. A bendable stiffening member is interposed between the covering layer and resilient material forming a sandwich-like construction. The peripheral edges of the resilient material and the covering layer extend beyond the peripheral edges of the stiffening member. The novel construction provides a generally cylindrical protective means when the device is worn. Suitable fastening means are provided to retain the device on the wearer's hand, palm and wrist.

14 Claims, 7 Drawing Figures

PROTECTIVE DEVICE FOR THE HAND

BACKGROUND OF THE INVENTION

This invention relates to a protective device adapted to be worn on a person's hand, palm and wrist. The device of the present invention provides protection when the wearer is engaging in various sports and particularly, skateboarding. This invention also relates to the use of the protective devices to substantially immobilize injured joints or bones in the hand or wrist as a temporary or permanent splint. In a recent survey, it was estimated that more than 100,000 various types of skateboard injuries occurred in one year with many of these injuries being attributed to children 10 to 14 years of age. In almost all cases, the injured victims had not been wearing any kind of protective equipment.

A person engaging in the sport of skateboarding can possibly lose his balance, slip off the skateboard, or the skateboard may slip out from under the person, etc. When such happens and the person falls, the person usually attempts to break his fall by extending his arms and usually falls on them thereby possibly causing injuries to the hands, palms, and wrists.

The device as above described for use in skateboarding is not limited thereto, and can be used while engaging in other sports such as football, hockey, etc.

Various types of protective devices have been utilized heretofore and one such device, as disclosed in U.S. Pat. No. 3,921,222, provides a multisectioned device with a stiffening element capable of being bent, as a rib cage protector.

SUMMARY OF THE INVENTION

It is an object of this invention to provide a novel unitary protective device for a person's hand, palm and wrist to be worn while engaging in the sport of skateboarding, football, etc. as to prevent injuries, or to be worn after an injury as a temporary or permanent splint.

Another object of this invention is to provide a novel protective device of simplified construction for the hand, palm and wrist of a person, comprising a resilient, energy-absorbing plastic foam material which can be covered with a tough, pliable, material such as plastic, and which is relatively inexpensive.

Another object of the invention is to provide a device for wearing on a person's hand, palm and wrist which protects against injury when one falls while engaging in a sport.

A further object of the invention is to provide a device for protecting a person's hand, palm and wrist after injury by preventing substantial movement of the hand, palm and wrist.

Generally, the protective device of this invention comprises a generally rectangular member having a contoured shape adapted to be worn and generally cover the hand, palm and wrist comprising a resilient and energy-absorbent material, preferably a plastic foam material, a tough outer covering layer and an interposed stiffening member. Suitable securing means are provided for holding the device on the hand, palm and wrist.

DETAILED DESCRIPTION OF THE INVENTION

Figure 1:
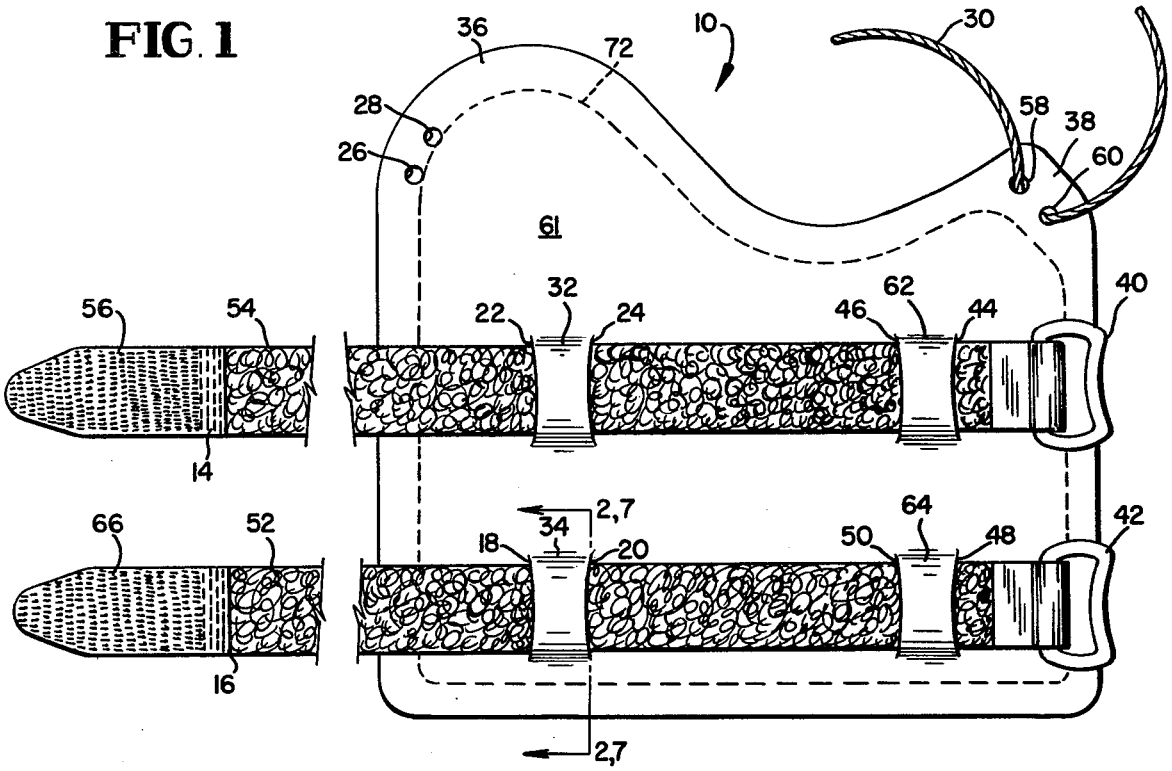
FIG. 1 is a top planar view of the protective device.

The protective device of the invention is generally designated by the numeral 10. It comprises a contoured, generally rectangular shape having a sandwich-like construction comprising an outer covering layer 68, an interposed bendable stiffening member 72, an inner, energy-absorbing material 74, securing means 14 and 16, and tying means 30.

The outer covering layer 68 has outer surface 61 and is a flexible, tough, pliable, material such as plastic, nylon reinforced plastic, leather, and the like, which has the overall rectangular contoured shape of the device. It comprises slits 22, 24, 46, and 44 which form loop members 32 and 62 for retaining strap member 14, and slits 18, 20, 50 and 48 which form loop members 34 and 64 for retaining strap member 16. Contoured portions 36 and 38 of the device comprise holes 26, 28, 58 and 60 through which tying means 30 can be threaded and tied as shown in FIGS. 3, 4, 5 and 6.

The bendable stiffening member 72 has the same overall contoured shape of the device but is slightly smaller in size. It can be a thin sheet of any suitable material capable of being bent or flexed without breaking having a high impact strength such as a plastic material, e.g. high density polyethylene, a metal e.g. aluminum, and the like.

The inner energy-absorbent material 74 has the overall contoured shape of the device and is a flexible, resilient, energy-absorbent material such as may be formed from polystyrene, polyurethane, rubber foam and the like and which can be inexpensively produced by stamping or cutting from a sheet of foam material. Preferably, material 74 comprises a closed-cell plastic foam material, rather than an open cell plastic foam material, due to the enhanced energy-absorbing qualities of the closed-cell plastic foam material. For example, on the market today, there are various closed cell, unicellular, plastic foam materials formed of many tiny closed cells filled with a gas such nitrogen. These materials are very light, have very good strength and high shock absorbency and have a generally smooth surface. The materials can be used by themselves or they can be vinyl coated for additional strength by dipping, spraying or brushing. An example of these unicellular plastic materials is "ENSOLITE" (Registered trademark of Uniroyal Corporation) which is a blend of nitrile rubber and polyvinylchloride.

FIG. 1 shows the device of this invention wherein resilient plastic foam material 74, stiffening member 72, and outer covering layer 68 are formed so as to give the sandwich-like construction of member 10. The peripheral edge of stiffening member 72 is shown by the dotted line in FIG. 1 and is inwardly displaced from the peripheral mating edges of plastic foam material 74 and outer covering layer 68. Stiffening member 72 is retained in its inwardly displaced position by securing the mating edges of plastic foam material 74 and outer covering member 68 by suitable means, such as glueing, heat sealing, stiching and the like. Retaining strap member 14 is shown threaded through slits 22, 24, 46, 44 and under retaining loop members 32 and 62. Retaining strap member 16 is shown threaded through slits 18, 20, 50, 48 and under retaining loop members 34 and 64. Tying means 30 is shown laced through holes 58 and 60 of contoured portion 38, and are also laced through holes 26 and 28 of portion 36 whereby the tying means retain the two portions 36 and 38 together when the device is worn as shown in FIGS. 3–6.

Figure 2:
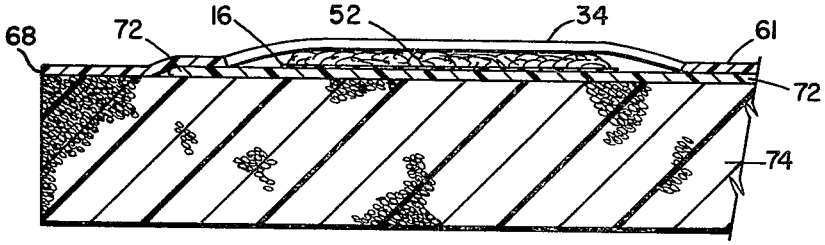
FIG. 2 is a cross section taken along line 2—2 of FIG. 1.

FIG. 2 shows the sandwich-like construction of member 10 taken along line 2—2 of FIG. 1, showing the layered arrangement of plastic foam material 74, stiffening member 72, retaining strap member 16 and outer protective covering layer 68. Stiffening member 72 is interposed between plastic foam material 74 and outer covering layer 68, and is inwardly displaced from their mating edges. This inward displacement can vary, but is typically one half inch to about one inch. This inward displacement can vary along the peripheral edges of the device and may be of different magnitude on the lateral and longitudinal edges or along any two lateral or longitudinal edges.

Figure 3:
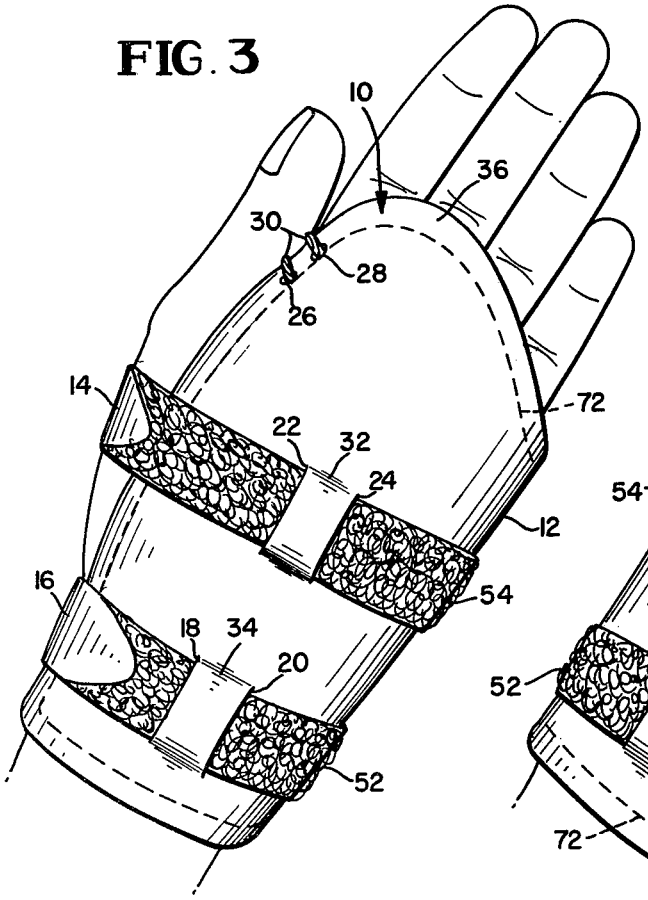
FIG. 3 is a perspective view of the device of FIG. 1 as worn on the left hand, palm and wrist of a wearer showing a palm view while engaging in skateboarding.
Figure 4:
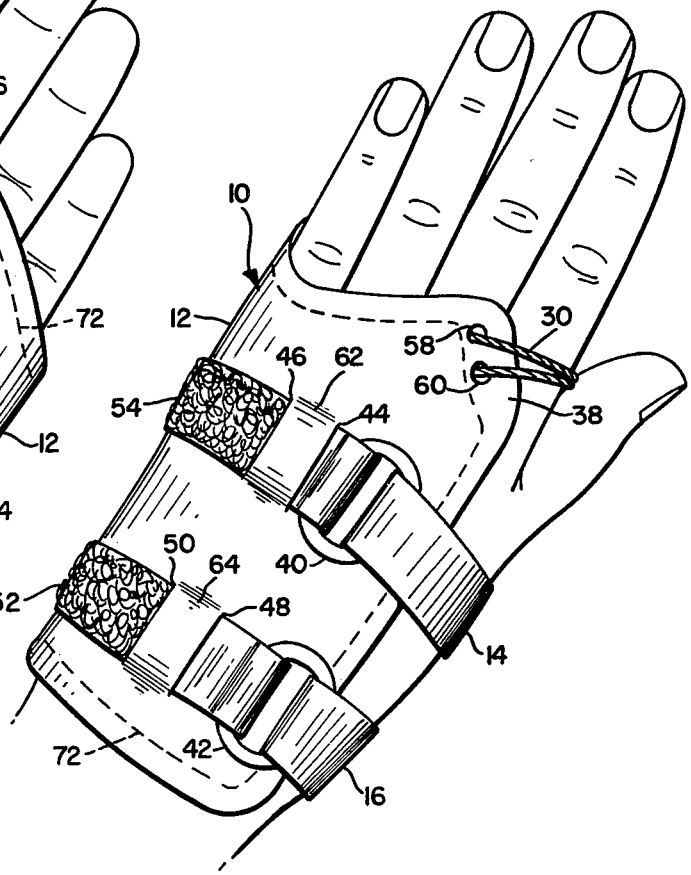
FIG. 4 is a perspective view of the device as worn in FIG. 3, as seen from the back of the hand.

FIGS. 3 and 4 show the device, as worn, when the device is used for a sport such as skateboarding and the like. FIG. 3 shows member 10 wherein contoured portion 36 provides the protective means for the palm of the wearer and the other portions provide protection for the rest of the hand and wrist. FIG. 4 shows the back-hand view of the device, as worn in FIG. 3, wherein contoured portion 38 of the protective member provides protection for the back of the wearer's hand and wrist. FIGS. 3 and 4 show the device, as worn, wherein member 10 is bent around the wearer's hand, palm and wrist in a generally cylindrical shape retained by tying means 30. After initially securing the tying means 30 the device will remain secured even when the device is removed. The device, as shown in FIGS. 3 and 4, is placed on the hand, palm and wrist of the wearer so that the wearer's thumb extends between tying means 30 and retaining strap member 14. Retaining strap member 14 is placed through buckle 40 and retaining strap member 16 is placed through buckle 42 whereby the device is secured by some suitable means, such as VELCRO material with pile threads, 52 and 54, and material-engaging hooks, 56 and 66. As shown in FIGS. 3 and 4, member 10 forms a rigid, generally cylindrical surface 12 whereby the wearer's hand, palm and wrist are protected.

Figure 5:
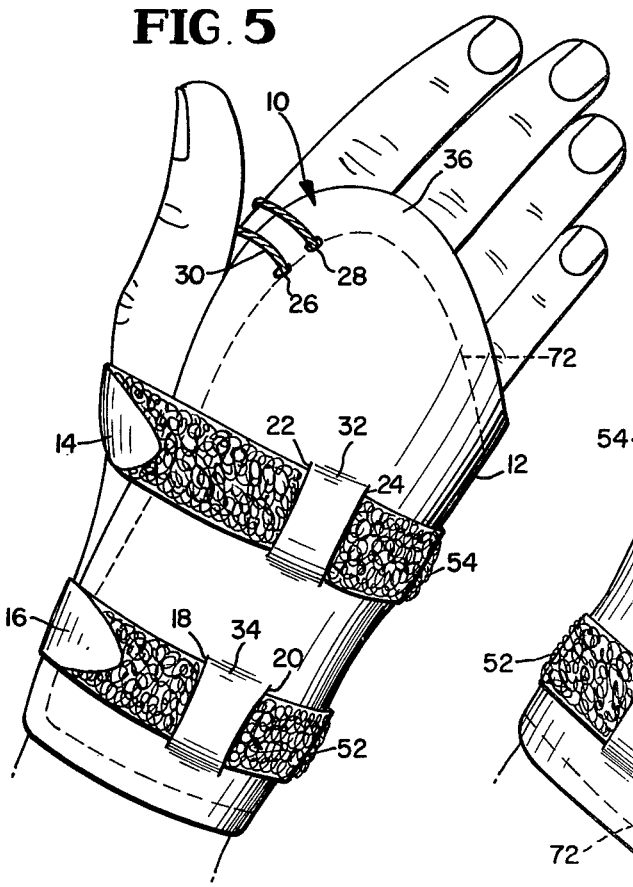
FIG. 5 is a perspective view of the device as worn on the right hand, palm and wrist of a wearer while engaging in football, etc., as seen from the back of the hand.
Figure 6:
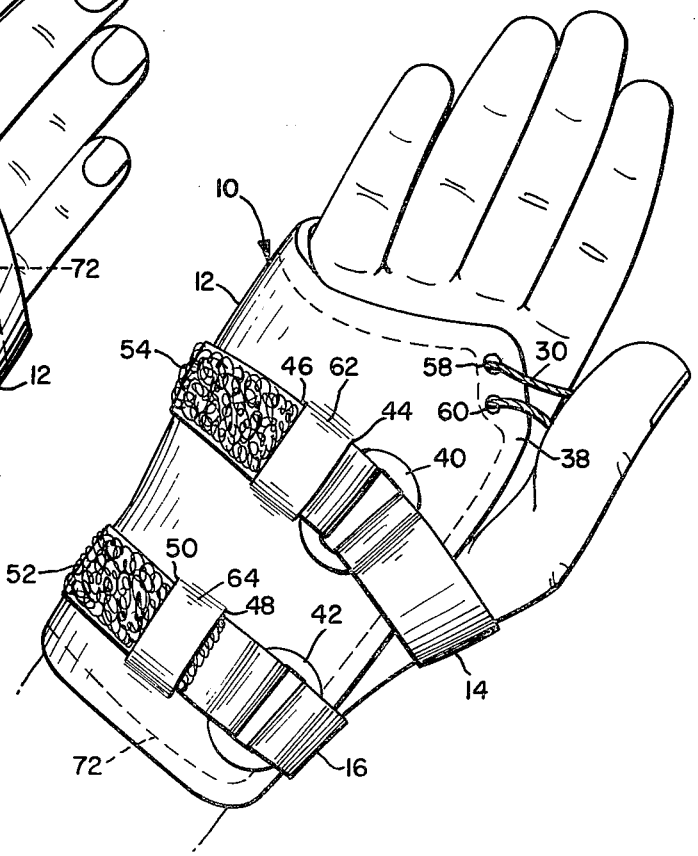
FIG. 6 is a perspective view of the device as worn in FIG. 5, as seen from the palm of the hand.

FIGS. 5 and 6 show the device, as worn, when engaging in a sport such as football, hockey, etc. FIG. 5 shows the device wherein contoured member 36 provides the protective means for the back of the wearer's hand, and FIG. 6 shows the device wherein contoured member 38 provides the protective member for the wearer's palm. Tying means 30 is secured, as above, and wearer's thumb extends between tying means 30 and retaining strap member 14. Retaining strap members 14 and 16 are secured by placing said retaining strap members through buckles 40 and 42, respectively, and securing by suitable means, as above mentioned.

As shown in FIGS. 3 and 4 the device provides protection for the wearer's hand, palm and wrist with contoured member 36 covering the wearer's palm. Contoured member 36 provides protection for the wearer's palm when the wearer is engaging in skateboarding and falls or contacts some object with his palm. Contoured member 38 provides protection for the back of the wearer's hand. The device when worn in this manner affords maximum protection for the palm of the wearer.

As shown in FIGS. 5 and 6 the device provides protection for the wearer's hand, palm and wrist with contoured portion 38 covering the wearer's palm. Contoured portion 36 provides protection for the back of the wearer's hand. The device when worn in this manner affords maximum protection for the back of the wearer's hand when engaging in a sport such as football, hockey, etc. wherein the hand can be stepped on, etc.

The device of this invention also provides a protective function for the wrist of the wearer as member 10 is bent around the hand, palm and wrist wherein a rigid, generally cylindrical surface 12 is formed. As the device is bent so as to encircle the hand, palm and wrist a rigid, generally cylindrical shape and surface is formed for the unitary stiffening member. This novel protective shape and construction is provided in the device as shown and worn in FIGS. 3, 4, 5 and 6.

Figure 7:
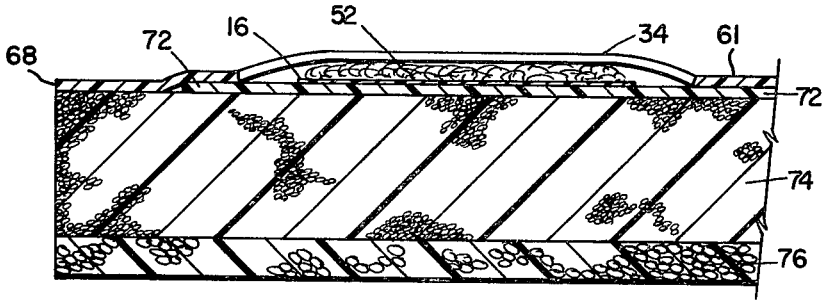
FIG. 7 is a cross section taken along line 7—7 of FIG. 1 similarly as line 2—2 wherein a second embodiment of the invention is shown.

In addition to the above disclosed embodiment, additional embodiments are envisioned as within the scope of this invention. FIG. 7 shows another embodiment wherein the sandwich-like construction of member 10 comprises an additional layer to the three layer construction shown in FIG. 2. FIG. 7 shows a sandwich-like construction of member 10 taken along line 7—7 of FIG. 1, where the device is shown comprising the outer protective covering 68, retaining strap member 16, stiffening member 72, plastic foam material 74 and an additional inner protecting layer 76. Inner protecting layer 76 has the overall contoured shape of the device 10 and comprises a softer flexible, resilient, energy-absorbent material than layer 74. Inner protecting layer 76 is preferrably an open-cell plastic foam material. The use of an inner protecting layer 76 aids in preventing the ventilation problems associated with closed-cell plastic foam materials placed against the wearer's skin. Inner protective layer 76 can be made of other suitable materials such as linen, felt, and the like.

The above mentioned embodiments of the device of this invention have an additional function wherein the hand, palm and wrist are retained substantially immobile when the device is worn, as shown in FIGS. 3–6. This ability to substantially immobilize the hand, palm and wrist enables the use of the device as a temporary or permanent splint.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A protective device for a person's hand, palm and wrist having a generally rectangular shape of a person's hand and a sandwich-like construction comprising an outer layer of a tough, pliable material, an inner layer of energy absorbing material, and a bendable stiffening member, which is bendable about a palm and wrist, interposed between said outer and inner layers, the peripheral edges of said outer and inner layers being held together and the peripheral edges of said stiffening member disposed near said peripheral edges of said inner and outer layers, said device including securing means for retaining the device on a wearer's hand.

2. The device of claim 1 wherein said device comprises an additional layer of an energy-absorbing material bound to said inner layer having ventilation properties.

3. The device of claim 1 wherein said outer layer is a plastic material.

4. The device of claim 1 wherein said inner layer is a closed-cell plastic foam material.

5. The device of claim 1 wherein said stiffening member is an impact-resistant plastic material.

6. The device of claim 1 wherein said securing means comprises strap means adapted to pass through loop means disposed in said outer layer.

7. The device of claim 1 wherein portions of the device are retained together by tying means.

8. The device of claim 1 wherein the stiffening member is a metal.

9. A sandwich-like construction adapted to be used in devices for protecting parts of a human body, comprising a first layer of a tough, pliable plastic material, a second layer of an energy absorbing plastic foam material, a bendable stiffening member interposed between said first and second layers, the stiffening member being bendable about a part of a body, the peripheral edges of said first and second layers being held together, and the peripheral edges of said stiffening member disposed near said peripheral edges of said first and second layers.

10. The sandwich-like construction of claim 9 wherein a third layer of energy-absorging plastic foam material having ventilation properties is secured to said second layer.

11. The sandwich-like construction of claim 9 wherein the peripheral edges of said stiffening member are disposed inwardly from said peripheral edges of said second layer of energy absorbing material.

12. The device of claim 1 wherein the peripheral edges of said stiffening member are disposed inwardly from said peripheral edges of said second layer of energy absorbing material.

13. The device of claim 1 wherein the securing means hold the sandwich-like construction in a generally cylindrical shape encircling a hand, palm and wrist, thereby forming a rigid cylindrical shape and surface of the stiffening member.

14. A sandwich-like construction of claim 9 wherein the securing means hold the sandwich-like construction in a generally cylindrical shape encircling a part of a human body, thereby forming a rigid cylindrical shape and surface of the stiffening member.

* * * * *